United States Patent [19]

Zeliszkewycz

[11] 4,359,025

[45] Nov. 16, 1982

[54] CONTINUOUS FLOW FUEL INJECTOR FOR INTERNAL COMBUSTION ENGINES

[76] Inventor: Stefan Zeliszkewycz, 1854 N. Lake Dr., Troy, Mich. 48084

[21] Appl. No.: 101,639

[22] Filed: Dec. 10, 1979

[51] Int. Cl.[3] ..... F02B 19/02

[52] U.S. Cl. ..... 123/275; 123/292; 123/294; 123/568; 123/557

[58] Field of Search ..... 123/557, 275, 294, 292, 123/568, 429; 239/88, 91, 456, 533.12

[56] References Cited

U.S. PATENT DOCUMENTS

| | | | |
|---|---|---|---|
| 1,476,012 | 12/1923 | Hvid | 123/275 |
| 3,580,231 | 5/1971 | Bradbury | 123/292 |
| 3,762,378 | 10/1973 | Bitonti | 123/557 |
| 3,809,030 | 5/1974 | Moiroux | 123/292 |
| 3,999,525 | 12/1976 | Stumpp | 123/557 |
| 4,246,873 | 1/1981 | Lih-Liaw | 123/48 AA |

*Primary Examiner*—Ronald H. Lazarus
*Attorney, Agent, or Firm*—John R. Benefiel

[57] ABSTRACT

An injector arrangement is disclosed in which liquid fuel in variable quantities is received within an injector chamber in a continuous flow. The admitted fuel is stored and intermixed with hot high-pressure burnt gases retained from previous combustion period for timed injection during or near the end of the compression stroke. During the intermixing period in the injector chamber preheated liquid fuel is partly or fully vaporized. Cam operated linkage is set up to hold over the injector in an open position until hot high-pressure burnt gases of combustion can re-enter the injector chamber for the next fuel charge preparation. A variable delivery liquid fuel pump provides for fuel quantity regulation according to torque output requirements. A tiny capillary passage at the entrance to the injector chamber provides the necessary flow restriction to obtain continuous fuel flow. Disclosed are two injectors of slightly different construction eliminating the need for return springs.

9 Claims, 4 Drawing Figures

CONTINUOUS FLOW FUEL INJECTOR FOR INTERNAL COMBUSTION ENGINES

BACKGROUND OF THE INVENTION

1. Field of the Invention

This invention concerns internal combustion engines and more particularly an arrangement for injecting prevaporized fuel into the combustion chambers of a piston and cylinder type internal combustion engine.

2. Description of the Prior Art

Internal combustion gasoline engines available heretofore operate at low thermal efficiency because of the reduced compression ratio of such engines mandated by the use of unleaded gasoline grades. The combustion process in such engines is often irregular and is notably affected by frequent pre-ignition problems which are manifested in noisy knocking and pinging of the engine at times of quick acceleration. Low thermal efficiency of course contributes to a very poor utilization of gasoline fuel resulting in a low miles per gallon ratio of transportation vehicles. Several heretofore available gasoline injection systems failed to improve compression ratios of spark ignited engines and thus there was no improvement made in thermal efficiency in such engines.

This is at a time when the efficiency of the engine is becoming increasingly important with the greatly increased costs of petroleum fuels.

Diesel type internal combustion engines heretofore have been quite expensive to manufacture due to high precision and accuracy required during production of variable volume fuel injectors. A second negative aspect of prior art diesel engines is the time lag between the moment of injection and the moment of full vaporization of fuel which affects these engines' starting capability and causes such engines to operate at relatively slow speed.

This invention solves those problems which the prior art failed to resolve by providing a system which will increase substantially the compression ratio of gasoline engines and eliminate the undesirable time lag in conventional diesel engines. Furthermore fuel injectors and associated fuel delivery systems disclosed are of very simple construction, very economical to manufacture and present great savings in material and weight.

SUMMARY OF THE INVENTION

It is an object of this invention to raise the compression ratio of internal combustion engines and in particular that of gasoline engines beyond present levels thus improving overall thermal efficiency of the engine.

It is also an object of this invention to provide a fuel injecting system wherein fuel is supplied to injectors in a continuous flow resulting in a substantially simplified system.

Another object of this invention is to utilize the high pressure and high temperature of burnt gases of combustion of previous combustion cycle to prevaporized fuel prior to the injection into the combustion chambers.

Still another object of this invention is to utilize the energy of the burnt gases of previous charge to achieve a high velocity dispersal of vaporized fuel within the combustion chamber reducing ignition time lag of the charge to a minimum.

It is further an object of this invention to preheat fuel supplied to injectors utilizing waste heat of exhaust gases.

It is also an object of this invention to minimize emission of unburnt hydrocarbons of internal combustion engines, in particular that of two-cycle gasoline engines.

These and other objects are accomplished by a simple fuel injection system consisting of a variable delivery fuel metering pump one or more fuel injectors each of which includes an injector chamber. A unique feature of this system is the high pressure entry of fuel into the injector chamber in a continuous flow. This is accomplished by a minute capillary passage at the entry to the injector chamber. The capillary passage produces restriction to the flow of fuel which is proportional to the pressure in the fuel line. The volume of the injector chamber is approx. 5 to 20 times larger than the volume of liquid fuel entering the injector chamber for each combustion cycle.

Another important feature of the system is that a volume of high pressure and high temperature gases of combustion are allowed to enter the injector chamber where it is retained by closing of an injector valve to provide energy for next cycle evaporation and high velocity injection of fuel charge into the combustion chamber of the engine. The fuel charge continuously delivered to the injector evaporates injector chamber and forms a homogeneous mixture with the trapped volume of combustion gases. The fuel gas mixture is subsequently injected into the combustion chamber during or near the top of the compression stroke. In a first embodiment, this injection is achieved by opening of the valve and the expulsion by the high pressure of the retained volume of gases. This embodiment is applicable to constant volume engines, such as spark ignited gasoline engines.

In a second embodiment, suitable for constant pressure or diesel engines, the injection is achieved by a cam shaft actuated plunger which sweeps the mixture from the injector chamber. As mentioned before, fuel injected into the combustion chamber in vaporized form will ignite instantaneously thus reducing ignition time lag associated with liquid injection systems. Vaporized fuel within the injector chamber is considerably diluted by retained gases of combustion. This aspect of the invention reduces fuel losses due to leakage along moving parts of the injector. Unavoidable small amount of leaked fuel-gas mixture is recycled back to the air intake manifold. Furthermore reduced fuel loss does permit a certain relaxation of close tolerance requirements in the manufacture of mating parts of injectors.

Customary lapping operations of the moving parts of the injectors can be substituted with conventional precision machining and grinding operations. This method will contribute substantially to the reduction of manufacturing costs.

This invention thus presents a fuel injection system that consists of minimum parts, is economical to produce and is universally applicable to diesel, gasoline, butane, propane, natural gas, synthetic fuel, alcohol and similar type engines.

DETAILED DESCRIPTION OF THE INVENTION

In the following detailed description, certain specific embodiments will be described in accordance with the requirements of 35 USC 112 and specific terminology utilized in the interest of clarity, but it is to be understood that the same is not intended to be limiting and indeed should not be so construed inasmuch as the invention is capable of taking many forms and variations within the scope of the appended claims.

Figure 1:
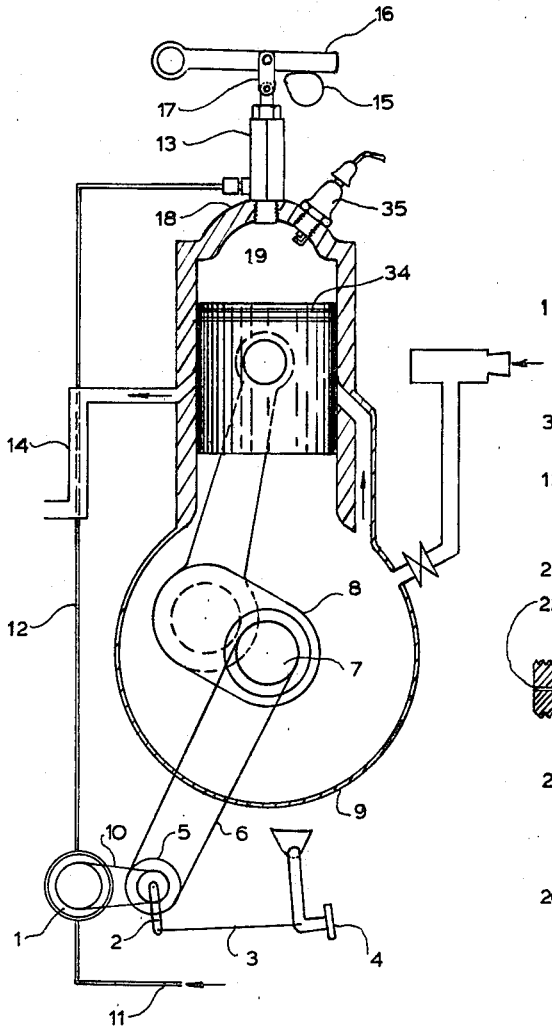
FIG. 1 is a diagrammatic representation of an internal combustion engine equipped with the fuel delivery system into which injectors according to the present invention are incorporated.

Referring to FIG. 1 a fuel delivery system is shown which includes a liquid fuel metering pump 1 having a variable speed mechanical drive control device 2 operated by means of a flexible control cable 3 secured to the accelerator pedal lever 4. Such variable speed devices are well known and can take the form of a variable pitch pulley 5 which carries an endless belt 6 which is operated by means of pulley 7 securedly fixed to crankshaft 8 of the internal combustion engine 9. Finally endless belt 10 transmits torque to fuel metering pump 1. Fuel metering pump 1 is adapted to receive liquid fuel via tube 11 in communication with a vehicle fuel tank not shown and deliver its output under high pressure to fuel line 12 tightly connected to fuel injector 13. A variation in speed of variable pitch pulley 5 produces a corresponding variation in pressure in fuel line 12 which in turn regulates the quantity of fuel delivered to fuel injector 13. A section of the fuel line 12 is surrounded by tube 14 leading off hot exhaust gases to atmosphere. Waste heat of exhaust gases is thereby transferred to fuel in line 12 preheating it prior to entry into injector 13 which is securedly attached to wall 18 of combustion chamber 19. Timed operation of fuel injector 13 is carried out by camshaft 15 in connection with lever 16 and link 17. As it is customary, camshaft 15, which is engine driven, will also operate other engine valving as required.

Figure 2:
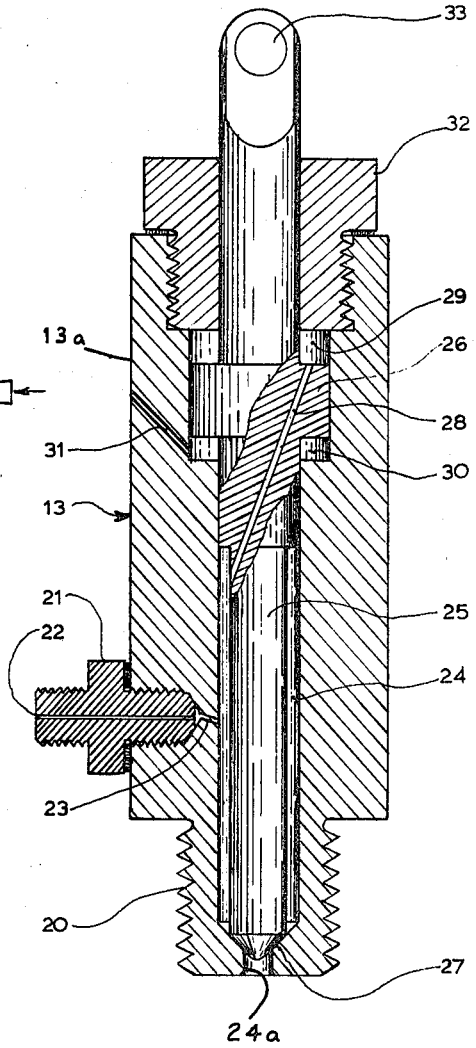
FIG. 2 is a vertical cross-sectional view of a spindle valve type fuel injector incorporated in the fuel delivery system of FIG. 1.

Depicted in FIG. 2 is fuel injector 13, having a housing **13*a* with the lower end formed into an external thread 20 for mounting to combustion chamber wall 18. In the lower portion of injector housing 13*a* there is threadably attached a fitting 21 with flow restricting capillary passage 22 functioning as a pressure retaining device for fuel line 12. It is noted that fuel is delivered to injector 13 in a continuous flow under higher or lower pressure in said line 12 which causes larger or smaller volume of fuel to flow through capillary passage 22 into the interior of injector 13. The length and diameter of capillary passage 22 is selected for maximum steady flow delivery of fuel for stoichiometric combustion and minimum delivery of fuel for idling purposes of the engine. The passage 23 is adapted to atomize and spray fuel into an injector chamber 24 formed in the housing and able to be placed into communication with the combustion chamber 19 via passage 24*a*. The volume of the injector chamber 24** is approx. 5 to 20 times larger than the volume of liquid fuel required for stoichiometric combustion with air charge of one cycle.

A needle type spindle valve 25 is used to seal off the injector chamber 24 from communication with the combustion chamber 19 during expansion, exhaust and intake strokes. Upper part of spindle valve 25 incorporates a piston 26 which is used to exert downward pressure on spindle valve 25 for airtight seating against seat 27 surrounding passage **24*a* of the injector housing 13*a*. Spindle valve 25 further incorporates a pressure transmitting passage 28 for high pressure gas transfer to an upper pressure chamber 29**.

Lower chamber 30 contains no pressure and is vented through passage 31 which also serves as lubricant supply opening. The upper part of injector 13 housing is closed off by threadably attached cover 32. The incorporation of the piston 26 eliminates the use of bulky springs for spindle valve closing purposes, resulting in substantial simplification of injector.

The uppermost part of spindle valve 25 accommodates bore 33 for linkage 17 attachment.

The operation of the injector 13 is in timed relationship with the movement of piston 34 of engine 9 shown in FIG. 1.

Engine 9 represents a two-cycle spark ignited constant volume combustion engine. As is well known, by reference to appropriate technical literature, such an engine operates in a medium pressure range. Pressure at the end of compression stroke is moderate. However during the combustion process the pressure suddenly rises to a theoretical fourfold magnitude. This feature of sudden pressure increase is utilized in the operation of the injector 13. In existing liquid fuel injectors great importance is placed in regards to quick closing of the injector 13 immediately after fuel expulsion.

Conversely, the spindle valve 25 of the injector 13 is made to open for fuel injection somewhat before the end of compression, when air pressure in the combustion chamber 19 is still moderate. Thereafter spindle valve 25 remains open well into the combustion period. This method permits very hot gases at top pressure to enter injector chamber 24 via passage **24*a* wherein they are trapped after spindle valve 25 has closed the injection chamber 24**. Preheated fuel is continuously fed into these hot gases causing it to evaporate.

Thus pressure in the chamber 24 is considerably higher at the moment of injection than it is at the same time in the combustion chamber 19. The energy of the hot highly compressed gases is utilized for efficient high velocity dispersing of fuel throughout the combustion chamber 19.

FIG. 1 shows engine 9 at the point of fuel injection with piston 34 well advanced into the compression stroke. The pressure of the air charge in the combustion chamber 19 is still moderate. In contrast, at the same moment the pressure of vaporized fuel and hot gases within injector chamber 24 is theoretically four to five times higher than the air charge pressure. This pressure difference provides the basic principle for injector 13 operation. At the start of injection high pressure within injector chamber 24 provides the necessary energy for thorough dispersion of the fuel charge in the combustion chamber 19. After the injection, spindle 25 remains in lifted position until several degrees past top dead center leaving the injector chamber 24 open for entry of the high pressure and high temperature gases of combustion.

Soon thereafter, spindle valve 25 descends to close off the injector chamber 24, to retain the hot gases and accumulate fuel continuously admitted through capillary passage 22 for the next cycle of injection. Spark control of spark plug 35 is accomplished through usual vacuum utilization as applied to present day gasoline engines.

Figure 3:
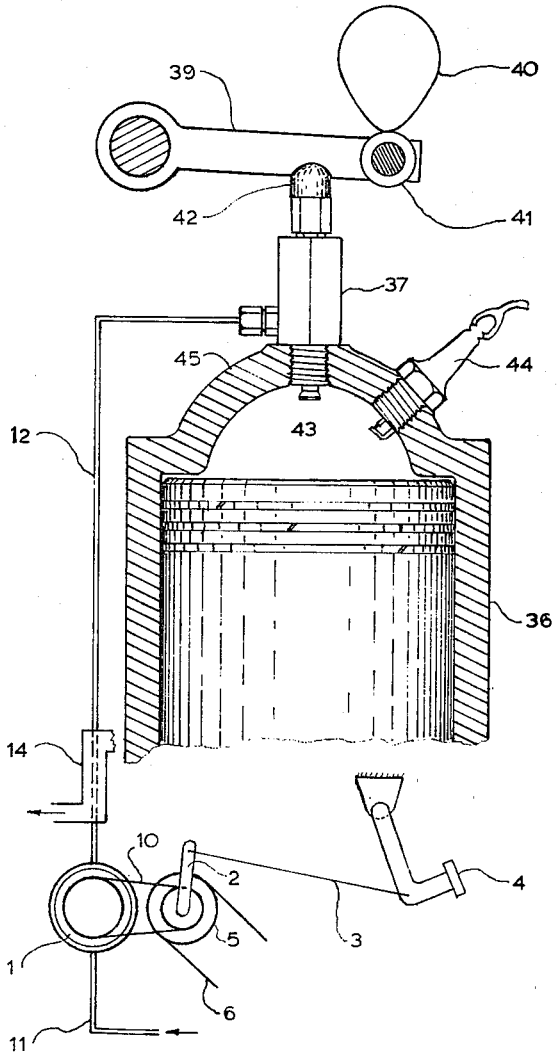
FIG. 3 shows part view of an internal combustion engine incorporating a fuel delivery system with an alternative form of injector actuation.
Figure 4:
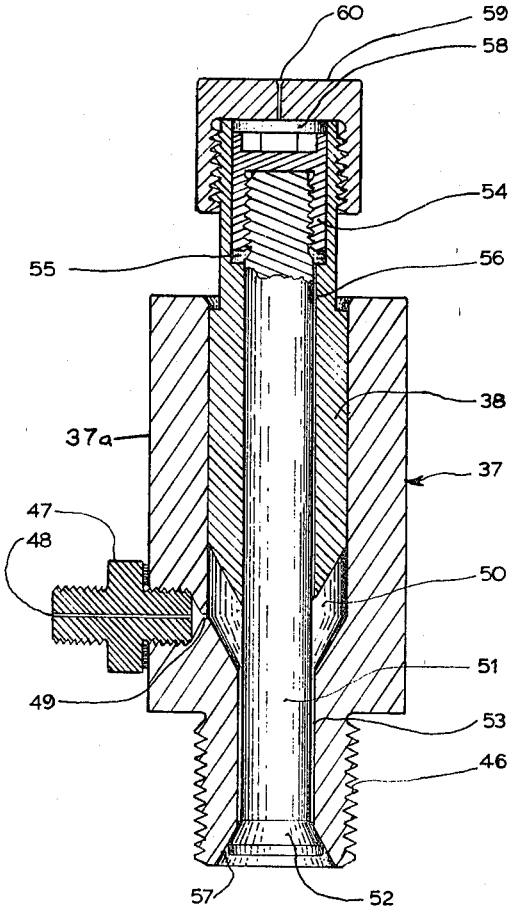
FIG. 4 is a vertical cross-sectional view of a plunger type fuel injector incorporated in the fuel delivery system of FIG. 3.

Depicted in FIG. 3 is the upper part of engine 36 which may be a two-cycle or a four-cycle internal combustion engine of compression ignition type which incorporates a plunger type injector 37 shown in detail in FIG. 4.

This fuel delivery system works on continuous pressure related flow of fuel and is composed of the same components as for engine 9 shown in FIG. 1. Plunger type injector 37 is of an alternative construction in order to accommodate different pressure conditions prevailing in compression ignition engines. However the principle of retention of high pressure and high temperature products of combustion within an injection chamber, fuel preheating, continuous flow and vaporization of fuel, all are equivalent for both types of injectors.

Compression ignition engines however do not produce any marked pressure increase during the combustion segment of the cycle, hence their classification of being constant pressure combustion engines. The flat pressure curve of those engines necessitates certain assistance for expulsion of vaporized fuel from the injector chamber 50 during the injection process. Injector 37 is therefore provided with a positive expulsion plunger 38 for quick and total ejection of injector chamber 50 contents. This is a downstroke mode of operation which requires a different arrangement of actuating lever 39 and camshaft 40 due to larger forces required for plunger downstroke movement against high combustion pressure.

A roller 41 is added to lever 39, also a spherical link 42 is provided to eliminate angular misalignment.

Maximum pressure in the combustion chamber 43 is similar to pressures used in diesel engines. Likewise a glow plug 44 is shown for easy cold weather starting.

FIG. 4 shows the plunger type fuel injector 37 having a housing 37*a* with the lower part thereof formed within external thread 46 for mounting to the combustion chamber wall 45. In the lower portion of injector 37 there is threadably attached a fitting 47 incorporating a flow restricting capillary passage 48 functioning as a pressure retaining device for fuel line 12.

The length and diameter of capillary passage 48 is selected to produce maximum steady flow delivery of fuel for stoichiometric combustion and minimum delivery of fuel for idling purposes of the engine. Passage 49 is adapated to atomize and spray fuel into an injector chamber 50 which may be placed in communication with the combustion chamber 43 via a passage 53. The volume of injector chamber 50 is approximately 5 to 20 times larger than the volume of liquid fuel required for stoichiometric combustion, with the air charge of one cycle. Rod 51 is formed with a conical bottom end 52 used to seal off the injector chamber 50. Expulsion of the injector chamber 50 contents is accomplished by downward movement of the plunger 38. The top end of plunger 38 is used to accommodate a thermal expansion self-adjusting arrangement. There is marginal lost movement allowed between plunger 38 and rod 51 as shown in FIG. 4. The top end of the rod 51 has a threadably attached piston 54 which is allowed to slide in an enlarged bore 55 in the top end of plunger 38.

Passage 56 is provided for high pressure gas to pass through into space in the bore 55 and act on the underside area of piston 54 for proper seating of conical end 52 in the recess 57 of injector body. Space 58 represents the temperature expansion margin for rod 51. The top of plunger 38 is closed off by threadably attached cap 59 in which a passage 60 is incorporated for venting and lubricating purposes.

Passage 53 which is made sufficiently larger than the diameter of rod 51 provides for high velocity expulsion of the contents of chamber 50.

FIG. 3 shows engine 36 at the point of completed fuel injection with rod 51 and plunger 38 having been pushed down by cam 40 to its lowest point of travel. Upward return stroke of rod 51 and plunger 38 occurs as in the first embodiment during the combustion period of the cycle so that hot high pressure gases of combustion can re-enter injector chamber 50 to provide a high pressure gas cell for the next cycle fuel preparation before the actual injection time.

Notably for reasons of clarity the usual conventional parts of the system such as stop valves, safety valves, adaptors and other tubular fittings have been omitted from the specification, nevertheless it is understood that these items would normally be required in the practical application of this invention.

The embodiments of the invention in which an exclusive property or privilege is claimed are defined as follows:

1. A fuel delivery and injection system for a piston and cylinder type internal combustion engine having a combustion chamber and means for supplying air thereto for compression by said piston during a compression stroke thereof prior to a power stroke produced by combustion of a fuel charge in said air compressed by said piston comprising:

an injector having an injector chamber formed therein, and a passage enabling communication of said injector chamber with said engine combustion chamber;

valve means controllably establishing communication between said injector chamber and said combustion chamber via said passage;

fuel supply means for delivering atomized liquid fuel into said injection chamber;

drive means for opening and closing said valve means in timed relationship to said piston movements, said means opening said valve means during the completion of the compression stroke and maintaining said valve means open after combustion is initiated for a time period of a duration to enable a volume of the combustion gases to enter and fill said injection chamber; said drive means thereafter closing said valve means to retain said volume of combustion gases in said injection chamber for the next cycle, whereby said fuel is mixed with said combustion gases in said injection chamber, and enabled to be dispersed into said combustion chamber upon opening of said valve means.

2. The fuel delivery and injection system of claim 1 wherein said fuel supply means includes a variable delivery pump means having an inlet and outlet adapted to pump fuel from a fuel supply into said inlet at selectively controllable pressures and further includes a metering passage entering into said injection chamber and also includes means connecting said outlet of said variable pump means with said metering passage to cause fuel to be continuously dispersed into said injection chamber at variable rates supplied from said variable pump means.

3. The fuel delivery and injection system of claim 1 wherein said volume of said injection chamber is from 5 to 20 times the volume of fuel delivered to said injector chamber by said fuel supply means for each engine cycle.

4. The fuel delivery and injection system of claim 1 further including plunger means mounted in said injection chamber expelling the contents thereof upon opening of said valve means.

5. The fuel delivery and injection system of claim 1 further including means preheating said fuel supplied by said fuel supply means by exhaust gases from said engine.

6. The fuel delivery and injection system of claim 1 wherein said internal combustion engine includes an engine driven camshaft and wherein said valve means includes a valve member and a valve seat surrounding said passage said valve member movable onto said valve seat to close off a communication between said combustion chamber and said injection chamber, said valve means further including means driving said valve member by said camshaft to move said valve member off said valve seat whereby controllably establishing said communication of said injection chamber with said combustion chamber in timed relationship to said engine piston movements.

7. The fuel delivery and injection system of claim 6 wherein said valve means further includes a piston member affixed to said valve member, and a bore slidably receiving said piston, with a closed space defined between said piston and said bore defining a pressure chamber which when pressurized tends to force said valve member against said valve seat, and means establishing communication between said injection chamber and said pressure chamber whereby pressurizing said pressure chamber with gases contained in said injection chamber to thereby enable return on said valve member onto said seat.

8. The fuel delivery and injection system of claim 6 wherein said valve member comprises a rod. and said injection chamber comprises a larger diameter bore surrounding said valve member, and further including a plunger slidably mounted in said bore and on said valve member and movable through said injection chamber to expel the contents thereof through said passage into said combustion chamber, and means driving said plunger in timed relationship with said engine to drive said plunger through said injection chamber and move said valve member off said valve seat.

9. THe fuel delivery and injection system in claim 8 wherein a last motion connection is provided between said valve member and said plunger to accommodate thermal expansion.

* * * * *

UNITED STATES PATENT AND TRADEMARK OFFICE

CERTIFICATE OF CORRECTION

PATENT NO. : 4,359,025

DATED : Nov. 16, 1982

INVENTOR(S) : Zeliszkewycz

It is certified that error appears in the above-identified patent and that said Letters Patent are hereby corrected as shown below:

Column 1, line 61: delete ... prevaporized... and insert -- prevaporize --;

Column 2, line 27: after "evaporate" insert -- within the --;

Column 8, line 13: delete ... on ... and insert -- of --;

Column 8, line 27: delete ... last ... and insert -- lost --.

Signed and Sealed this

Fifth Day of April 1983

[SEAL]

*Attest:*

GERALD J. MOSSINGHOFF

*Attesting Officer*

*Commissioner of Patents and Trademarks*